US005339483A

United States Patent [19]

Byun

[11] Patent Number: 5,339,483

[45] Date of Patent: Aug. 23, 1994

[54] HOLDER FOR COSMETIC OR HYGIENIC ITEM

[75] Inventor: Y. K. Byun, Buchon City, Rep. of Korea

[73] Assignee: Cosmetech International Inc., New York, N.Y.; a part interest

[21] Appl. No.: 60,492

[22] Filed: May 11, 1993

Related U.S. Application Data

[63] Continuation of Ser. No. 733,725, Jul. 19, 1991, abandoned.

[51] Int. Cl.[5] ..... A46B 17/04

[52] U.S. Cl. ..... 15/184; 132/313; 132/317; 401/102; 401/117

[58] Field of Search ..... 15/144.4, 160, 169, 15/184; 132/313, 317, 318, 320; 401/102, 117, 262, 269

[56] References Cited

U.S. PATENT DOCUMENTS

| | | | |
|---|---|---|---|
| 187,694 | 4/1877 | Chaquette . | |
| 715,881 | 12/1902 | Scott . | |
| 1,067,596 | 7/1913 | Fesler . | |
| 1,182,235 | 5/1916 | Amrock | 15/184 |
| 1,268,976 | 6/1918 | Johnston . | |
| 1,321,907 | 11/1919 | Graham . | |
| 1,379,758 | 5/1921 | George . | |
| 1,506,590 | 8/1924 | Jaroslawski-Fioret | 401/102 X |
| 1,571,556 | 2/1926 | Nyhagen . | |
| 1,626,992 | 5/1927 | Willik . | |
| 1,953,251 | 4/1934 | Mitchell | 132/318 X |
| 2,556,473 | 6/1951 | Greene . | |
| 2,568,688 | 9/1951 | Shatkin . | |
| 2,604,985 | 7/1952 | Shatkin . | |
| 2,610,733 | 9/1952 | Balasevich | 132/318 X |
| 3,032,180 | 5/1962 | Grisel . | |
| 3,044,612 | 7/1962 | Levine . | |
| 3,205,523 | 9/1965 | Seaver | 15/169 X |
| 3,214,012 | 10/1965 | Mack | 132/317 X |
| 3,309,728 | 3/1967 | Seaver | 15/184 |
| 3,317,036 | 5/1967 | Cherba | 132/320 X |
| 4,248,543 | 2/1981 | Carrington et al. . | |
| 4,826,339 | 5/1989 | Sasaki . | |
| 4,917,133 | 4/1990 | Morel . | |

FOREIGN PATENT DOCUMENTS

| | | | |
|---|---|---|---|
| 710934 | 6/1954 | United Kingdom | 401/117 |

*Primary Examiner*—Timothy F. Simone
*Assistant Examiner*—Charles Cooley
*Attorney, Agent, or Firm*—Rosen, Dainow & Jacobs

[57] ABSTRACT

Holders for cosmetic or hygienic items such as brushes and lipsticks which include a sleeve which is manually moved in telescoping fashion from a base of the holder outwardly to enclose the item before the cap is applied to the holder to facilitate applying the cap and to prevent damaging the item when the cap is applied. In the preferred embodiment, the sleeve remains retracted in the base when the cap is removed from the holder thereby presenting the item exposed and ready for use upon removal of the cap. The sleeve is manually pulled out of the base to an advanced position prior to applying the cap. The cap is applied to and engages the sleeve so that pushing the cap towards the base retracts the sleeve into the base. Rotation is not required to expose the item, and the shape of the item and the holder need not be tubular. In one embodiment, a spring urges the sleeve out of the base and stops are provided holding the sleeve in the retracted and in an intermediate position. Release of the sleeve from the stop in the retracted position automatically advances the sleeve under the action of the spring to the intermediate position, and release of the sleeve from the stop in the intermediate position automatically advances the sleeve under the action of the spring to the advanced position.

6 Claims, 8 Drawing Sheets

HOLDER FOR COSMETIC OR HYGIENIC ITEM

This application is a continuation of application Ser. No. 07/733,725, filed Jul. 19, 1991, now abandoned.

BACKGROUND OF THE INVENTION

The invention relates to holders for cosmetic or hygienic items such as brushes, lipsticks, deodorant sticks, sun-tan sticks, lip balms, chap sticks, etc.

Holders for cosmetic or hygienic items typically comprise a base, a cosmetic or hygienic item movably mounted to the base, and a removable cap which engages the base or a structure mounted to the base to which the item is connected, and typically employ a mechanism which advances the item from the base by rotating part of the holder with respect to another part. It is difficult to apply the cap to the holder with the item exposed without contacting and possibly damaging the item because the sizes of the cap and the item are approximately the same. Therefore, the cosmetic or hygienic item is first retracted into the base to cover the item, and then the cap is applied, thereby protecting the item and facilitating applying the cap. The drawbacks of this type of holder are that it is difficult to operate smoothly and requires manual operations to both advance and retract the item. Also, due to the rotational motion required to advance and retract the item, the shape of such holders is limited to a cylindrical shape.

U.S. Pat. No. 3,044,612 to Levine and U.S. Pat. No. 4,826,339 to Sasaki both disclose holders having a base to which a lipstick (the Levine '612 Patent) or a brush (the Sasaki '339 Patent) is attached, a sleeve that slides into and out of the base to expose and cover the lipstick or brush, and a removable cap. The item is covered by the sleeve before the cap is applied. In the case of a lipstick, the covering sleeve prevents the cap from contacting the lipstick when the cap is applied. In the case of a brush, the covering sleeve reduces the spread of the brush and prevents the cap from being inserted into the bristle bundle, thereby facilitating applying the cap to the base over the brush.

In the Levine 612' Patent, the sleeve and the cap do not engage and the cap does not push the sleeve into the base when the cap is applied to the base. As a result, the sleeve remains covering the lipstick when cap is removed and must be manually pushed into the base before the lipstick may be used.

In the Sasaki '339 Patent, the covering sleeve does not telescope into the base and has two different diameters which are visible whether the brush is covered or exposed. The holder as a result appears to be longer than it otherwise need be and is not as streamlined and visually sleek in appearance as it might otherwise be. Moreover, the structure required to engage the covering sleeve with the cap and base has multiple contours which may increase manufacturing complexity and cost.

SUMMARY AND OBJECTS OF THE INVENTION

It is an object of the present invention to provide improved manually operated holders for cosmetic or hygienic items which cover the item when the cap is applied but which do not have the drawbacks of the holders described above.

It is another object of the present invention to provide improved manually operated holders for cosmetic or hygienic items in which the cosmetic item is easily uncovered for use and again easily covered for storage.

It is another object of the invention to provide such holders in which the uncovering and/or covering operations of the cosmetic item may be smoothly and easily carried out.

It is another object of the invention to provide such holders which suitably protect the cosmetic item during non-use and during the opening and/or closing operations.

It is another object of the invention to provide such holders which are of simple construction and are inexpensive to manufacture.

The foregoing and other objects are achieved in accordance with the invention by providing a holder for a cosmetic or hygienic item such as a cosmetic product or brush in which the item may be covered by a covering element in an advanced position of the covering element prior to applying the cap, and in which the covering element may be telescoped relative to the base to a retracted position of the covering element to expose the item for use. The cap engages the covering element in its advanced position so that pushing the cap towards the base moves the covering element to its retracted position. Preferably, the cap and the covering element disengage when the cap is removed without advancing the covering element to its advanced position, which has the advantage of presenting the cosmetic or hygienic item exposed and ready for use simply upon removal of the cap.

In one embodiment, the holder includes structure defining an intermediate position of the item between the advanced and retracted positions in which the covering element is held. Preferably in this embodiment, the covering element is resiliently urged against stops to automatically move upon release from a respective stop from the retracted to the intermediate position and from the intermediate to the advanced position.

In accordance with the invention, a holder for a cosmetic or hygienic item such as a cosmetic product or brush comprises a base having an open top end, a cosmetic or hygienic item coupled to the base and extending through the open top end thereof, a covering element sized to enclose the item movably mounted to the base to move longitudinally relative to the base from an advanced position where the covering element substantially covers the item to a retracted position substantially coextensive with the base where the item is substantially exposed, and a removable cap. The covering element has an engaging structure formed adjacent a top end thereof, and the cap has an open end adapted to fit onto the covering element and engage the engaging structure. When the covering element is in the advanced position and the cap is engaged with the engaging structure, the covering element may be moved to its retracted position by pushing the cap towards the base. Means are also provided for restricting movement of the covering element between the advanced and retracted positions.

The means for restricting movement of the covering element may comprise a first projecting structure extending from the covering element at a given location thereof and a second projecting structure engageable therewith extending from the holder at a given location thereof positioned to restrict movement of the covering element beyond the advanced position, and means defining a stop disposed adjacent a bottom end of the base engageable with a bottom end of the covering element.

The holder may also comprise means for resisting movement of the covering element away from the base when the covering element is in the retracted position. The movement resisting means and the engagement of the cap with the covering element are such that the cap, when fitted onto the covering element and engaged with the engaging structure, may be separated from the covering element without substantially advancing the covering element from the base. As a result, the item is exposed and ready for use when the cap is removed from the holder. In one embodiment, the movement resisting means may comprise a packing extending about the outer periphery of the covering element adjacent a bottom end thereof which frictionally engages the interior of the base to produce drag to movement between the two.

In preferred embodiments, the covering element is mounted to move from the retracted position telescoped within the base to the advanced position substantially out of the base, and the holder comprises a mounting element to which the item is mounted and means mounting the mounting element to the base. The covering element is mounted to telescope into the base enclosing a substantial portion of the mounting element in the retracted position of the covering element.

In preferred embodiments, the means mounting the mounting element to the base comprises a plug or collar element having a portion which engages a portion of the mounting element. In one embodiment, the plug or collar element comprises flexible hook elements which frictionally engage the interior of the covering element in the retracted position of the covering element to stabilize the covering element in its retracted position. The first projecting structure described above on the covering element may engage the hook elements to define another form of the movement resisting means described above.

In one embodiment, the holder may include means resiliently urging the covering element from the retracted position to the advanced position and means engaging and holding the covering element in the retracted position against the action of the urging means. The engaging means is selectively releasable to permit when released the urging means to automatically move the covering element from the retracted position to the advanced position. In another embodiment, the engaging means also engages and holds the covering element in an intermediate position between the retracted and advanced positions against the action of the urging means. The engaging means when released with the covering means in the retracted position permits the covering element to be automatically moved to the intermediate position by the urging means, and the engaging means when released with the covering means in the intermediate position permits the covering element to be automatically moved to the advanced position by the urging means, the engaging means automatically engaging and holding the covering means in the retracted position when moved thereto from another position.

In the preferred form of the embodiment described immediately above, the base, the covering element and the mounting element are all generally tubular, and the engaging structure comprises a projection and a guide slot with stops therein corresponding to the retracted and the advanced positions associated with the covering element and the mounting element, and the urging means comprises a coil spring bearing against the covering element and the holder to urge the covering element out of the base.

The holder may have any of a number of shapes, including but not limited to tubular, elliptical in cross section, rectangular in cross section, triangular in cross section, polygonal in cross section, etc. The individual elements of the holder may then have corresponding shapes.

BRIEF DESCRIPTION OF THE DRAWINGS

The above and other objects, aspects, features and advantages of the invention will be more readily perceived from the description of the preferred embodiments thereof taken in conjunction with the accompanying drawings, wherein.

Figure 1:
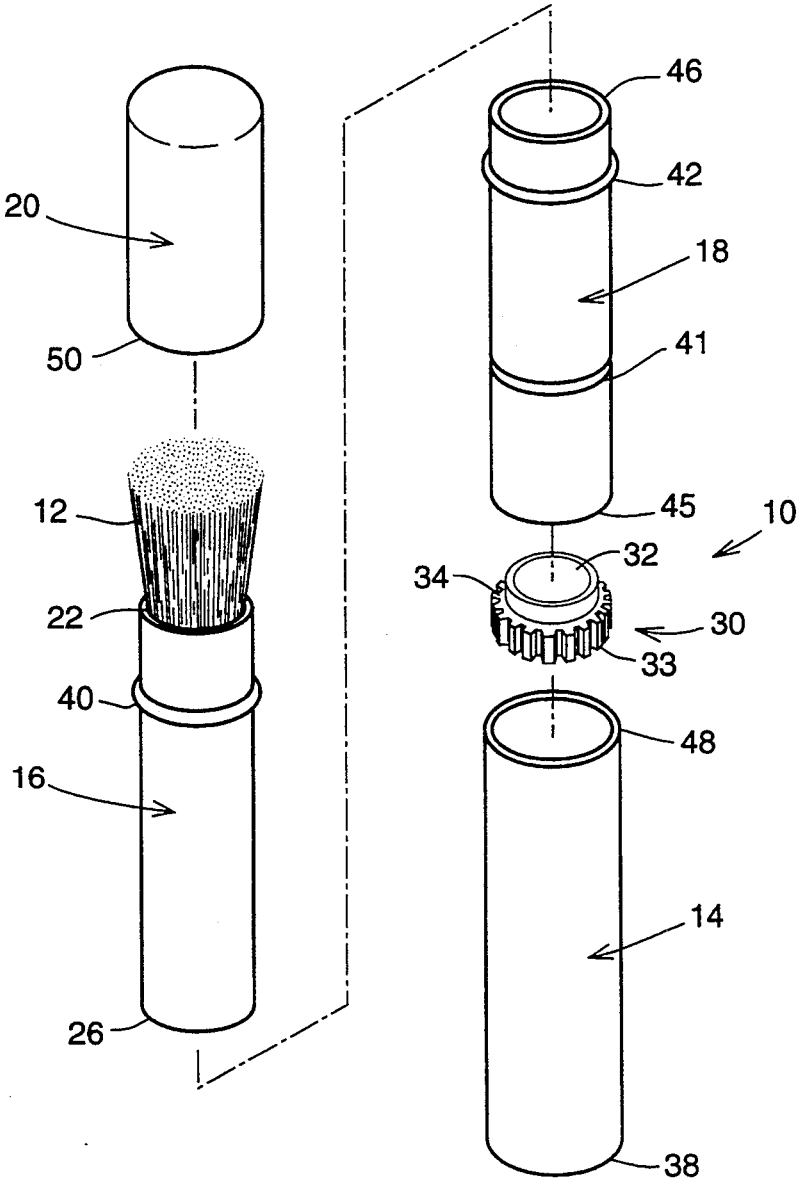
FIG. 1 is an exploded perspective view of a holder according to one embodiment of the invention.
Figure 4:
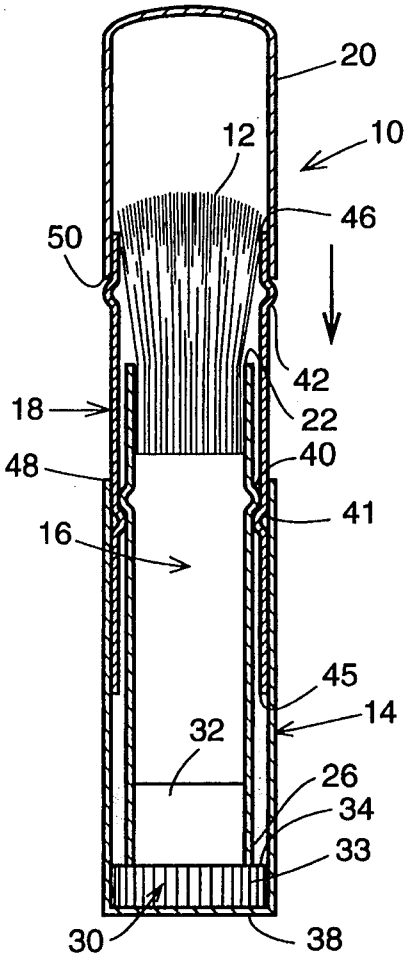
FIGS. 2, 3 and 4 are longitudinal sectional views of the assembled holder of FIG. 1 showing, respectively, the holder with the cap removed and the brush exposed for use; the cap off and the brush covered by a sleeve; and the cap engaged on the sleeve for closing the holder; together illustrating opening and closing of the holder.

Similar reference numerals refer to similar or corresponding elements throughout the various views. It will be understood that the invention is not limited to the embodiments described and that the drawings are for purposes of illustration only and are not intended as a definition of the limits of the invention.

DESCRIPTION OF THE PREFERRED EMBODIMENTS

In the embodiment of the invention shown in FIGS. 1–4, holder 10 holds a cosmetic or hygienic item in the form of a generally tubular brush 12. Various parts of holder 10 are correspondingly respondingly tubular.

Figure 2:
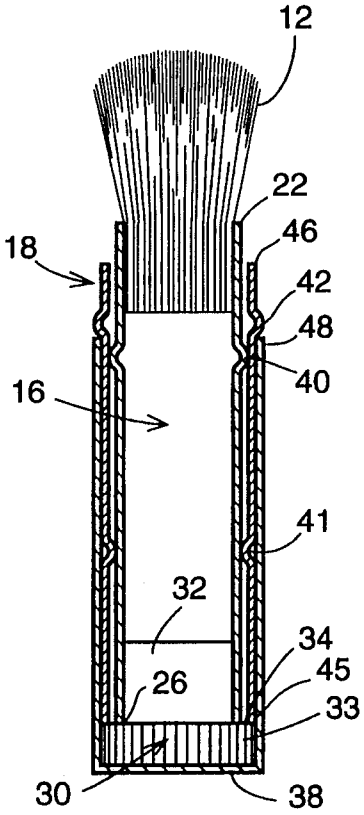

However, the brush and other parts of the holder may be of other corresponding shapes. Holder 10 comprises a tubular base 14, a tubular mounting sleeve 16 to which brush 12 is mounted, a tubular covering sleeve 18 which covers (FIG. 3) and exposes (FIG. 2) brush 12, and a removable cap 20. Mounting sleeve 16, covering sleeve 18 and base 14 are mounted in telescope scoping fashion, one in the other, as shown in FIG. 2. Covering sleeve 18 functions as a movable enclosure for brush 12 and is accordingly sized to enclose sleeve 16 and brush 12 and to slidably fit in base 14 to move longitudinally relative thereto between the retracted position of FIG. 2 substantially in base 14 exposing brush 12 for use and the advanced position of FIG. 3 substantially enclosing brush 12.

One end of the bristles forming brush 12 are fixed to the interior of mounting sleeve 16 adjacent end 22 of sleeve 16, and the other ends of the bristles project out through end 22 of mounting sleeve 16 a sufficient distance to permit the brush to be used as a cosmetic applicator, for example. The opposite or bottom 26 of sleeve 16 is open.

Mounting sleeve 16 for brush 12 is mounted to base 14 by a plug or collar 30 which includes a reduced diameter portion 32, a larger diameter portion 33 and a shoulder 34 at the junction of the larger and smaller diameter portions. Smaller diameter portion 32 is received in open end 26 of sleeve 16 up to shoulder 34 and is secured thereto. Knurled outer circumference of larger diameter portion 33 is received in base 14 and is secured thereto adjacent the bottom end 38 thereof, which is preferably closed. Plug smaller diameter portion 32 may be secured to sleeve 16, and the knurled portion 33 of plug 30 may be secured to base 14, by any suitable means, such as frictional engagement, an adhesive or ultra-sonic bond, or by pinning, etc. An adhesive bond is presently preferred.

Figure 1B:
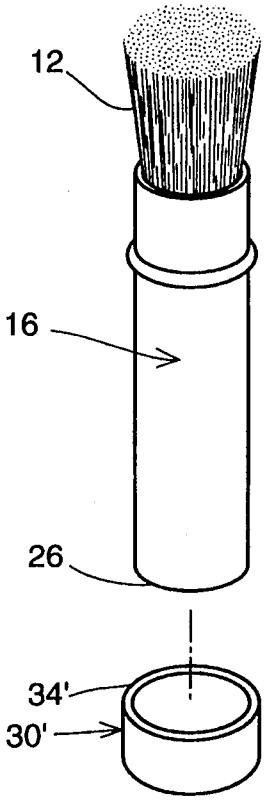
FIG. 1B is an exploded perspective view of a mounting sleeve and a plug or collar which are modified as compared to those elements in the embodiment of the holder depicted in FIG. 1.
Figure 5:
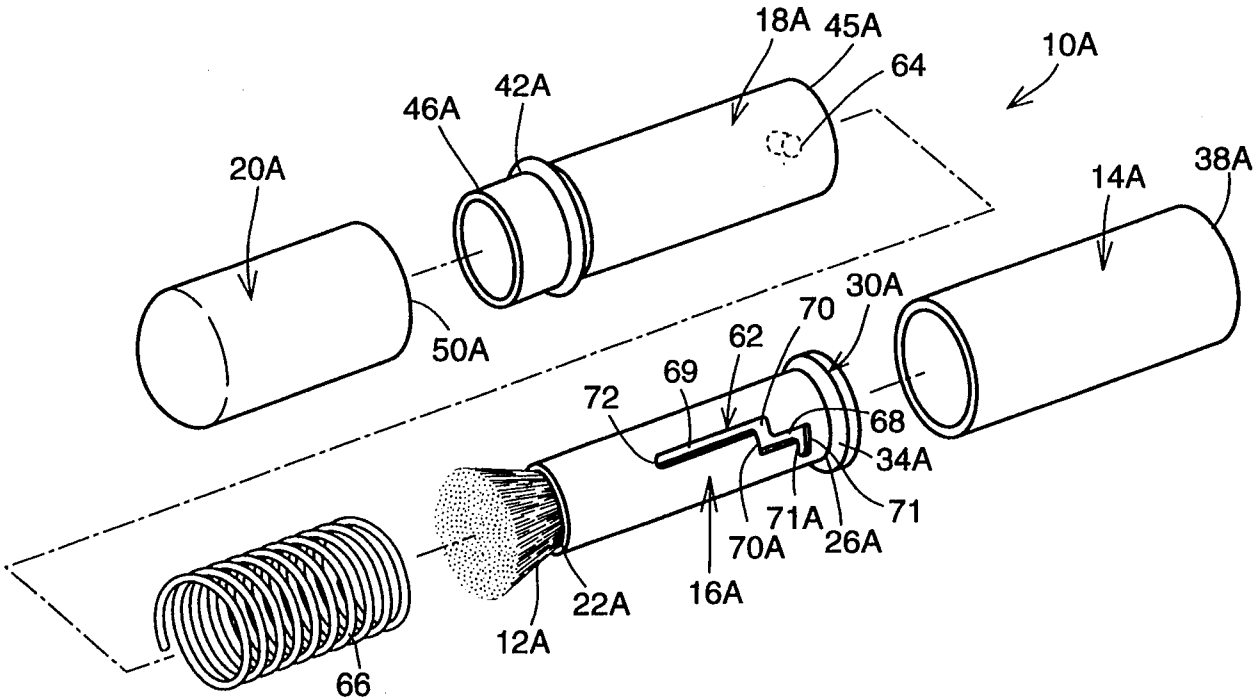
FIG. 5 is an exploded perspective view of a holder according to another embodiment of the invention.

FIG. 1B shows the presently preferred form of sleeve 16 and plug 30'. Plug 30' is simply a relatively short, tubular element having a closed bottom, i.e., plug 30' is cup-like, and is fitted onto to sleeve 16 adjacent end 26 thereof and secured thereto by an adhesive bond. The upper edge 34' of plug 30' functions as a stop for end 45 of covering element 18. Sleeve 16 in this embodiment may have an open or closed bottom end. Plug 30' is secured to sleeve 16 and to base 14 by respective adhesive bonds between respective facing surfaces.

Referring to FIG. 1, external projection 40 projecting from the exterior of mounting sleeve 16 and internal projection 41 projecting from the interior of covering sleeve 18 cooperate to limit advancement of sleeve 18 out of base 14, while shoulder 34 of plug 30 limits retraction of sleeve 18 into base 14. External projection 42 on covering sleeve 18 engages cap 20 for limiting movement of cap 20 over sleeve 18. Projections 40–42 are annular and run circumferentially about the respective sleeve surface.

FIG. 2 shows sleeve 18 fully retracted and telescoped over sleeve 16 with open bottom end 45 thereof abutting shoulder 34 of plug 30 and opposite top end 46 thereof protruding from base 14 fully exposing brush 12 with external projection 42 of sleeve 18 near end 46 thereof engaging the edge of the top end 48 of base 14. Travel of sleeve 18 out of base 14 from the position in FIG. 2 to the position in FIG. 3 is limited by engagement of external projection 40 on sleeve 16 and internal projection 41 on sleeve 18 as shown in FIG. 3.

Internal projection 41 on sleeve 18 contacts the outer circumference of sleeve 16 to provide a slight frictional drag resisting the motion of sleeve 18 relative to sleeve 16. Sleeve 18 may be moved from the FIG. 2 position substantially fully exposing brush 12, to the FIG. 3 position substantially fully covering brush 12 simply by grasping end 46 of sleeve 18 projecting from base 14 and pulling it away from base 14 against the frictional drag described above. If plug 30 is frictionally engaged with base 14, then the frictional drag provided by contact of projection 41 with sleeve 16 is less than the frictional engagement of plug 30 with base 14, so that brush 12 remains stationary while sleeve 18 is advanced out of base 14. Thus, brush 12 is stationarily mounted to base 14 in the embodiments of FIGS. 1 and 1B.

Figure 3:
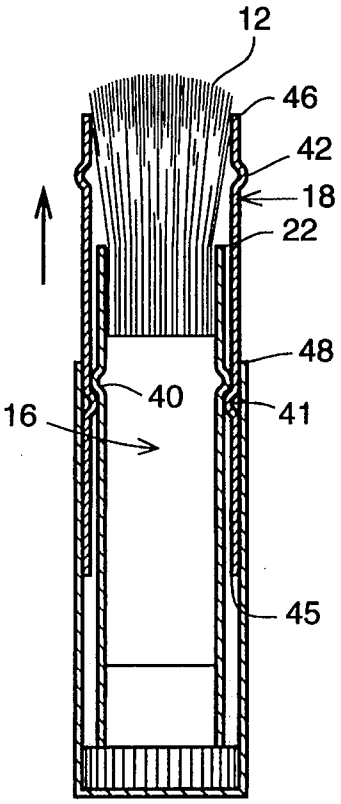

Sleeve 18 may be moved from the FIG. 3 position to the FIG. 2 position simply by pushing it into base 14 against the frictional drag described above until bottom end 45 of sleeve 18 abuts shoulder 34 of plug 30.

Removable cap 20 having an open end 50 fits onto sleeve 18 up to projection 42 and is frictionally engaged thereto. Such frictional engagement may be obtained by a close fit of the cap to the sleeve and/or by engagement of the cap with projection 42. Such frictional engagement also connects the cap to the holder, i.e., cap 20 is connected to base 14 indirectly via sleeve 18 and the frictional engagement of sleeve 18 with sleeve 16. The frictional engagement of cap 20 to sleeve 18 and the frictional drag provided by projection 42 may be such that the following opening sequences may be provided: movement of cap 20 away from base 14, i.e., opening the holder, advances sleeve 18 out of base 14 until projections 40 and 41 engage, at which time cap 20 will become disengaged from sleeve 18 with the sleeve 18 fully advanced; or such that cap 20 disengages from sleeve 18 when cap 20 is substantially immediately pulled away from base 14 with sleeve 18 substantially fully retracted. The latter opening sequence is preferred so that the cap is removed from the holder when the brush is substantially fully exposed and ready for use, as shown in FIG. 2.

To close holder 10 from its normal use configuration of FIG. 2 with sleeve 18 fully retracted into base 14, sleeve 18 is grasped and pulled to the position shown in FIG. 3 as described above, and then cap 20 is engaged with sleeve 18 as described above and as shown in FIG. 4, and pushed towards base 14 until the bottom end 45 of sleeve 18 abuts shoulder 34 of plug 30. Brush 12 is first covered by sleeve 18 before applying the cap to protect the brush and facilitate closing.

As described above, cap 20 engages the covering sleeve 18 and retracts the covering sleeve when the cap is applied, thereby positioning the covering sleeve in the retracted position and the brush ready to use when the cap is removed. Additionally, since covering sleeve 18 almost fully retracts into base 14 in the use position of FIG. 2, the holder presents a sleek and streamlined appearance, and may be kept to a relatively short length. Moreover, use of plug 30 to secure mounting sleeve 16 to base 14, and simple annular projections 40–41 for defining movement limits in cooperation with the plug, simplifies manufacture and reduces cost.

A cosmetic or hygienic item other than a brush, for example a lipstick, may be used in the embodiments of FIGS. 1–4.

FIGS. 5 through 8 depict another embodiment according to the invention of a holder 10A for a brush 12A. However, holder 12A may hold another cosmetic or hygienic item such as a lipstick as shown in FIG. 9. Holder 10A is similar to holder 10 in that it includes a base 14A, a mounting sleeve 16A, a covering sleeve 18A and a removable cap 20A. Holder 10A differs from holder 10 in that mounting sleeve 16A includes a guide slot 62 and covering sleeve 18A includes a radially inwardly projecting control pin 64 which cooperate together and with coil spring 66 to provide a spring release and advance for an initial advance of covering sleeve 18A out of base 14A (FIG. 7) and then for the full advance of sleeve 18A out of base 14A (FIG. 8), as described below. Guide slot 62 comprises two axial portions 68, 69 and two circumferential portions 70, 71. The upper edges 70A, 71A of circumferential slot portions 70, 71 and the top end 72 of axial slot portion 69 are curved to define stops limiting advancement of covering sleeve 18A from base 14A, as described below. Guide slot 62, control pin 64 and spring 66 replace the circumferential projections 40 and 41 in holder 10.

Mounting sleeve 16A has an enlarged diameter portion 30A at end 26A thereof which is secured to base 14A and sleeve 16A by any suitable means, preferably an adhesive bond. End 26A may be closed to provide a larger surface area for the adhesive to bond sleeve 16A to base 14A, and end 26A may have a relatively small recess (not shown) therein into which the adhesive extends to ensure that a strong bond is formed between sleeve 16A and base 14A. Thus, sleeve 16A is fixed to base 14A. Enlarged diameter portion 30A may be formed unitarily and integrally with sleeve 16A and secured to base 14A as described above. Also enlarged diameter portion 30A may be a plug or collar having a reduced diameter portion similar to that of plug 30 of holder 10, which reduced diameter portion is inserted into sleeve 16A and secured thereto by any suitable means, preferably an adhesive bond. Such a reduced diameter portion may extend adjacent guide slot 62, and if so, is recessed to receive control pin 64. The bottom of such a plug-type enlarged diameter portion 30A may have the recess therein described above for the adhesive.

Enlarged diameter portion 30A has a shoulder 34A which forms a seat for one end of coil spring 66. The other end of coil spring 66 bears against control pin 64 (FIGS. 6–8) and urges sleeve 18A axially away from sleeve 16A. Stops 70A, 71A and 72 limit axial movement of sleeve 18A away from sleeve 16A under the action of spring 66. Covering sleeve 18A has an exterior projection 42A which performs the same functions as projection 42 in holder 10. Holder 10A may be assembled in any convenient manner.

Figure 6:
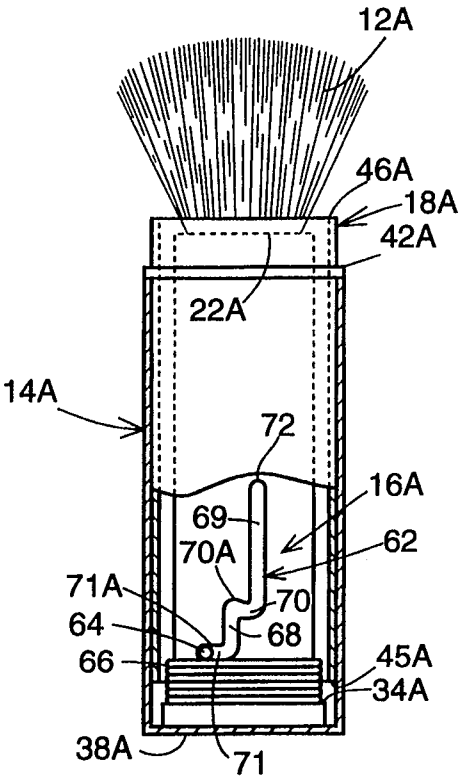

In operation, covering sleeve 18A remains retracted when cap 20A is removed to fully expose brush 12A, as shown in FIG. 6. In this configuration control pin 64 is engaged in stop 70 to prevent sleeve 18A from moving axially away from sleeve 16A and base 14A and the brush may be used in normal fashion. If a somewhat shorter or stiffer brush is desired, then covering sleeve 18A may be moved to the intermediate position shown in FIG. 7 by grasping the top end 46A of sleeve 18A and the base 14 and slightly relatively rotating the two so that control pin 64 moves in circumferential slot portion 70 into axial slot portion 68 when spring 66 will cause sleeve 18A to be advanced until control pin 64 engages circumferential slot 71. Brush 12A may be used in this configuration of holder 10A while sleeve 18A is still in a partially retracted/partially advanced, but stationary state.

Figure 8:
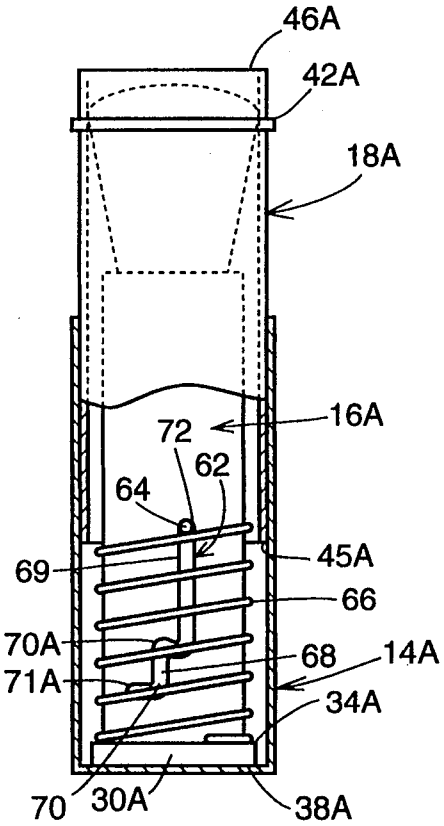
FIGS. 6, 7 and 8 are longitudinal sectional views of the assembled holder of FIG. 5 showing, respectively, the holder with the cap removed and the brush exposed for use; the cap off and the sleeve partially advanced to partially cover the brush; and the cap off with the sleeve fully advanced and covering the brush with the cap shown in phantom engaged to the sleeve for closing the holder; together illustrating opening and closing of the holder.
Figure 7:
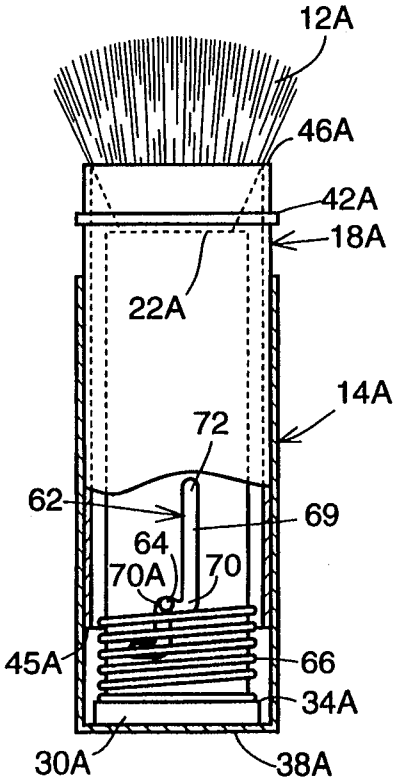
Figure 9:
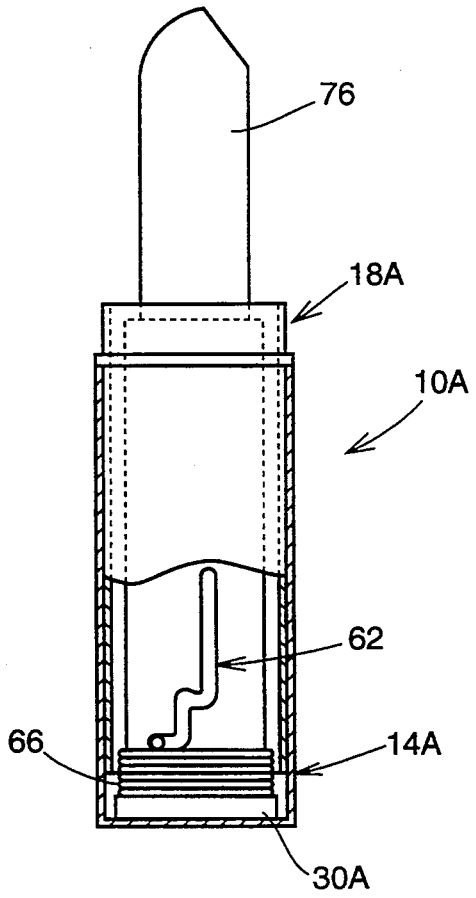
FIG. 9 is a longitudinal sectional view of a holder similar to that of FIGS. 5–8 but holding a lipstick instead of a brush.

To close holder 10A, covering sleeve 18A is moved to the position shown in FIG. 8 by grasping the top end 46A of sleeve 18A and the base 14 and slightly relatively rotating the two so that control pin 64 now moves in circumferential slot portion 71 into axial slot portion 69 when spring 66 will cause sleeve 18A to be advanced until control pin 64 engages the end 72 of axial slot 69. Cap 12A may now be inserted on to sleeve 18A up to external projection 42 and pushed towards base 14A with a slight rotating action to fully retract sleeve 18A. The rotating action causes control pin 64 to move from on slot portion to the adjacent slot portion until pin 64 is engaged in stop 70A. Holder 10 when closed appears as shown in FIG. 6 but with cap 20A attached to sleeve 18A.

The embodiment of FIGS. 5–8 may be provided with stops for advancement of sleeve 16A that do not require rotation of sleeves 16A, 18A and base 14A.

FIG. 9 illustrates the holder embodiment of FIGS. 5–8 but with a lipstick item 76 instead of a brush item.

FIGS. 10A, 10B, 11, and 12 depict another embodiment according to the invention of a holder 10B for a brush 12B similar to holder 10. However, holder 10B, unlike holders 10 and 10A is not tubular but rather is elliptical in cross section. Similar to holder 10, holder 10B includes a brush 12B, a base 14B, a mounting sleeve 16B, a covering sleeve 18B and a removable cap 20B. Holder 10B like holders 10 and 10A may hold items other than a brush, for example a deodorant stick. Holder 10B includes a plug 30B which is sized to fit in and be secured to base 14B by any suitable means, preferably by an adhesive bond. Plug 30B includes a projection 32B which is received in a like shaped receptacle 78 in end 26B of mounting sleeve 16B. As shown, projection 32B and receptacle 78 are rectangular in cross section.

Figure 11:
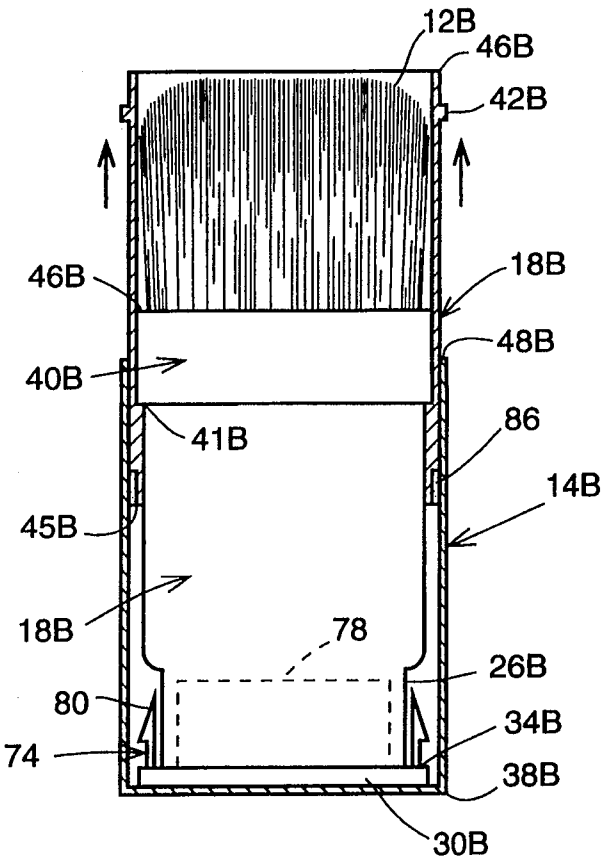

A pair of hook elements 74 flexibly projecting from plug 30B on each side of projection 32B stabilize covering sleeve 18B when sleeve 18B is fully retracted. Hook elements 74 are spaced from projection 32B sufficiently to permit sleeve 16B to enter therebetween as shown in FIG. 11. Hook elements 74 have hook portions 80 which enter into the bottom 45B of covering sleeve 18B such that the sharp edges 79 of hook portions 80 flexibly and frictionally engage the inner wall of covering sleeve 18B when sleeve 18B is fully retracted (FIG. 11). Hook portions 80 include a sloped surface 82 which cams hook elements 74 inwardly as sleeve 18B is retracted. Disposed about the exterior bottom portion of sleeve 18B is a packing 86 which frictionally engages the inner wall of base 14B. The frictional engagement of the bottom of sleeve 18B by hooks 74 and the frictional engagement of packing 86 with the inner wall of base 14B stabilizes sleeve 18B in its fully retracted position. Packing 86 also assists in providing smooth movement of sleeve 18B in base 14B. Such arrangement for stabilizing sleeve 18B is an improvement over the embodiment of FIG. 1.

Sleeve 16B has an exterior projection 40B and sleeve 18B has an interior projection 41B (FIG. 2) and an exterior projection 42B, which projections function as the corresponding projections 40, 41 and 42 on sleeves 16 and 18 of holder 10, as described above. In holder 10B, projections 40B–42B are wider than the corresponding projections in holder 10.

Referring to FIG. 11, when cap 20B is removed, sleeve 18B remains retracted in base 14B retained and stabilized by the frictional engagement of hook portions 80 with the interior of sleeve 18B and the frictional engagement of packing 86 with the interior of base 14B. Pulling cap 20B away from base 14B does not pull up sleeve 18B and presents brush 12B substantially fully exposed and ready for use.

Figure 12:
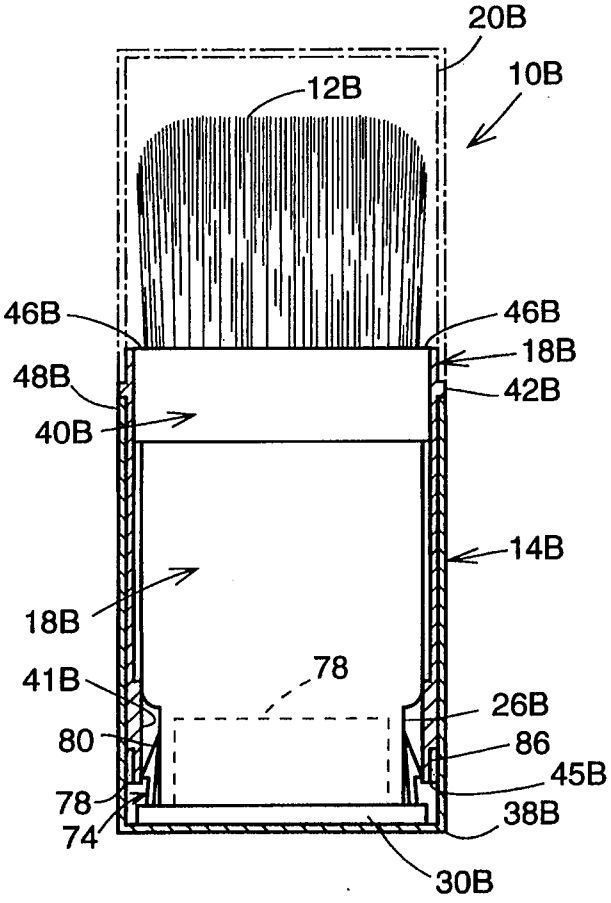
FIGS. 11 and 12 are longitudinal sectional views of the assembled holder of FIG. 10A showing, respectively: the cap off and the brush covered by a sleeve; and the sleeve retracted into the holder and the cap shown in phantom engaged on the sleeve; together illustrating opening and closing of the holder.

To close holder 12B, sleeve 18B is grasped and pulled away from base 14B, overcoming the frictional engagement of hook portions 80 with sleeve 18B and the frictional drag of packing 86 with base 14B, until projections 40B and 41B engage and sleeve 18B reaches the position shown in FIG. 12. Then cap 20B is slipped onto sleeve 16B until it engages with exterior projection 42B and pushed towards base 14B until the bottom 45B of sleeve 18B abuts shoulder 34B of plug element 30B and hook portions 80 enter and frictionally engage the bottom of sleeve 18B. Thus, the opening and closing sequences are similar to those for holder 10.

Figure 10A:
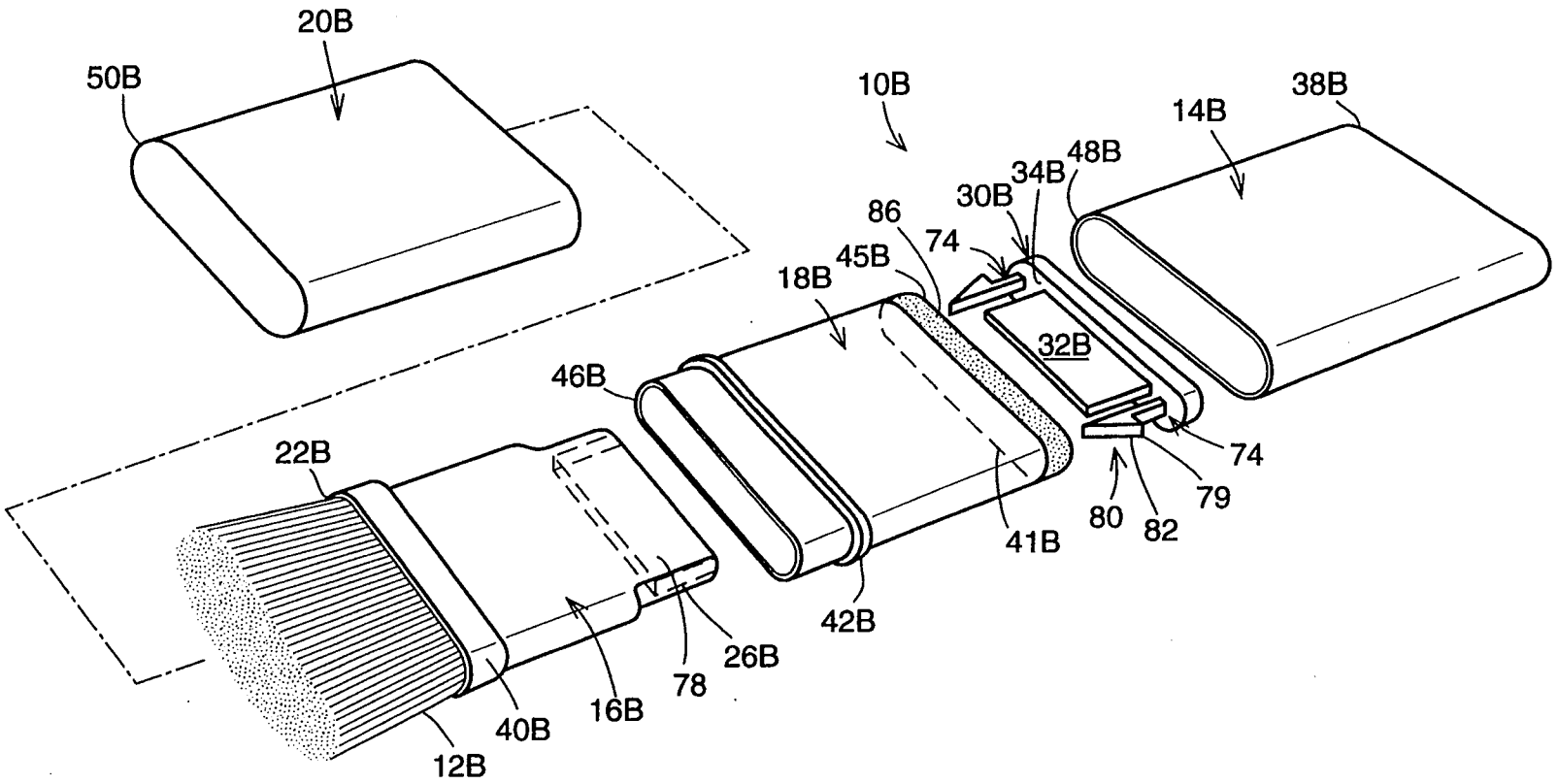
FIG. 10A is an exploded perspective view of a holder according to still another embodiment of the invention.
Figure 10B:
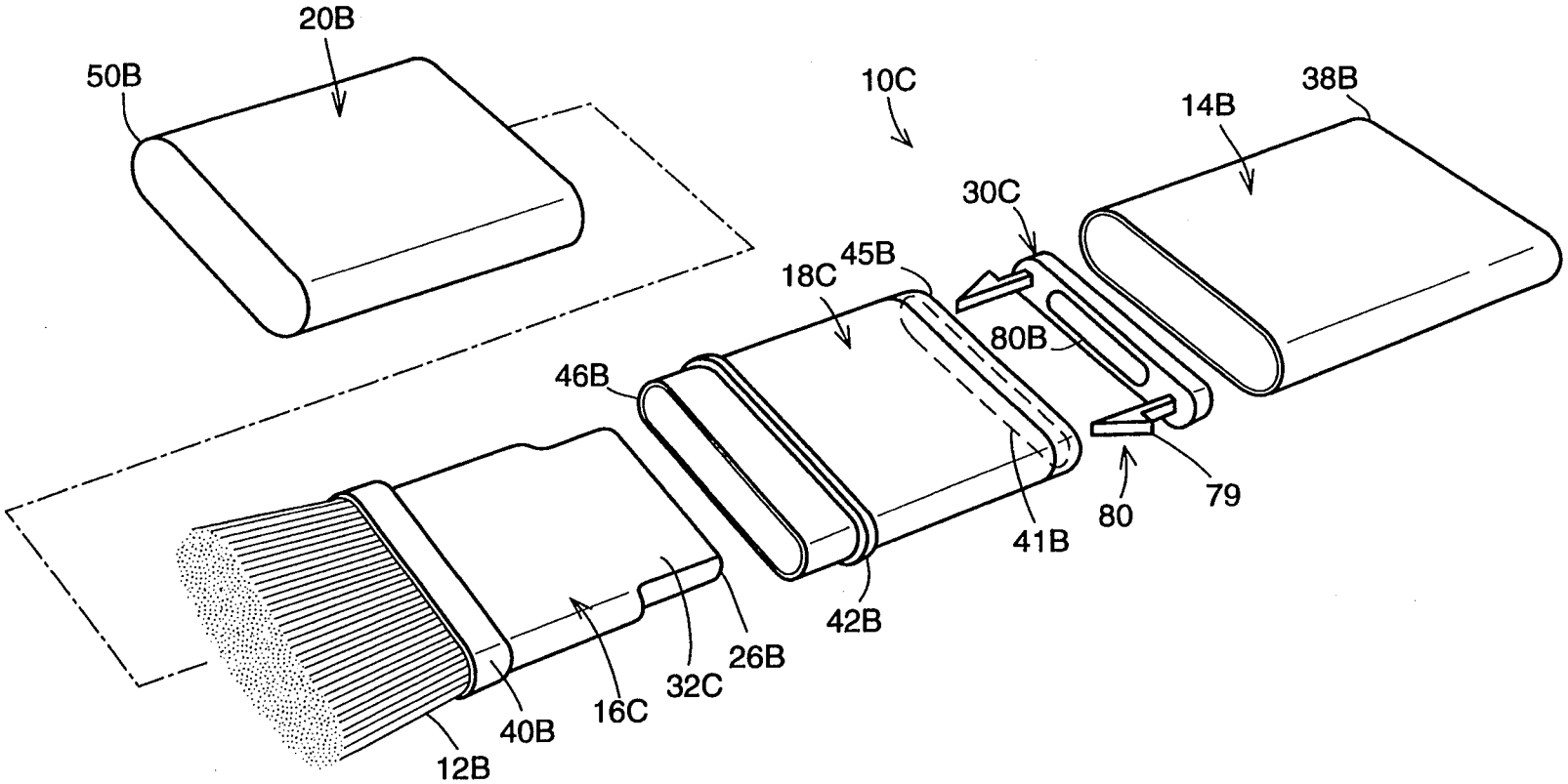
FIG. 10B is an exploded perspective view of a holder similar to that depicted in FIG. 10A but in which the mounting element, the sleeve element and the plug or collar element differ from those elements depicted in FIG. 10A.

FIG. 10B illustrates the presently preferred arrangement for securing sleeve 16B to base 14B. In this embodiment of holder 10C sleeve 16C has a projection 32C that is engaged in a receptacle 80B in plug 30C, which is secured in base 14B by an adhesive bond. Sleeve 18C in this embodiment has its inner projection 41B sufficiently close to the bottom edge of sleeve 18C to be engaged by the sharp hook edge 79 of hook portions 80. This engagement provides the initial resistance to movement of sleeve 18C away from base 14B in the retracted position of sleeve 18C, and is sufficient to maintain sleeve 18C fully retracted when cap 20B is removed.

Holders 10, 10A, 10B and 10C may be assembled in any convenient manner.

The use of a sliding, telescoping enclosure eliminates the need for rotation to uncover or retract the cosmetic or hygienic item in order to close the holder. The invention as embodied in holders 10, 10B and 10C (FIGS. 1–4 and 9–11) described above, and an embodiment similar to that of FIGS. 5–8 which uses a stop arrangement that does not require rotation, makes holders and/or items of various shapes possible because rotation is not required to expose the item for use. As to the embodiment of FIGS. 5–8, which utilizes a stop arrangement requiring limited rotation for release to expose the item, different shapes for the holder and/or item are also possible. For example, the holders and/items may be of circular, elliptical, rectangular, triangular, etc. cross-section, and different stop arrangements may be used.

Preferably, the cap, base and sleeves of holders 10, 10A, 10B and 10C are made of relatively thin plastic or metal material, but may be made of other materials if desired. The various parts of holders 10, 10A, 10B and 10C may interconnected by means other than those described.

While a number of embodiments of the present invention have been shown and described, it will be obvious to one skilled in the art that many changes and modifications may be made thereto by those skilled in the art without departing from the spirit and scope of the invention, and it is intended that the claims cover such changes and modifications to the extent that the prior art allows.

What is claimed is:

1. A holder for a cosmetic or hygienic item comprising:

a base having an open top end;

a cosmetic or hygienic item coupled to said base and extending through said open top end thereof;

a covering element movably mounted to said base to move longitudinally relative to said base and said item between an advanced position projecting substantially from said base and a retracted position substantially coextensive with said base, said covering element being sized such that in said projecting position thereof it substantially encloses said item and in said retracted position thereof it substantially exposes said item, said covering element having an engaging structure formed adjacent a top end thereof, wherein said covering element is mounted to move from said retracted position telescoped within said base to said advanced position substantially out of said base;

means for restricting movement of said covering element at said advanced and retracted positions;

a removable cap having an open end adapted to fit onto said covering element, and removably engage said engaging structure, said cap being sized such that it fully encloses that portion of said item exposed when said covering element is in its retracted position and said cap is engaged with said engaging structure;

said holder comprising a mounting element to which said item is mounted and means mounting said mounting element to said base, said covering element being mounted to telescope into said base enclosing a substantial portion of said mounting element in said retracted position of said covering element, wherein said means mounting said mounting element to said base comprises a plug element secured to said base, said plug element having a receptacle and said mounting element having a portion which is received and engaged in said receptacle.

2. A holder for a cosmetic or hygienic item comprising:

a base having an open top end;

a mounting element for a cosmetic or hygienic item mounted to said base with a space between said mounting element and said base;

said cosmetic or hygienic item mounted to said mounting element, said item extending through said open top end of said base;

a covering element sized to enclose said item and said mounting element, said covering element movably mounted to said base to move longitudinally with respect to said base in a telescoping fashion in the interior of said base in said space between said mounting element and said base from an advanced position where said covering element substantially encloses said item to a retracted position substantially in said base substantially covering said mounting element and substantially exposing said item, said covering element having an engaging structure formed adjacent a top end thereof;

means for restricting movement of said covering element at said advanced and retracted positions;

a removable cap having an open end adapted to fit onto said covering element and removably engage said engaging structure, said cap being sized such that it fully encloses that portion of said item exposed when said covering element is in its retracted position and said cap is engaged with said engaging structure.

3. The holder according to claim 2 wherein said cap engages said engaging structure and said covering element is movably mounted to said base such that said cap may be separated from said covering element when said covering element is in its retracted position.

4. A holder for a cosmetic or hygienic item comprising:

a generally tubular base having an open top end;

a generally tubular mounting element for a cosmetic or hygienic item mounted to said base with a space between said mounting element and said base;

said cosmetic or hygienic item mounted to said mounting element, said item extending through said open top end of said base;

a generally tubular covering element sized to enclose said item and said mounting element, said covering element movably mounted to said base to move longitudinally with respect to said base in a telescoping fashion in the interior of said base in said space between said mounting element and said base from an advanced position where said covering element substantially encloses said item to a retracted position substantially in said base substantially covering said mounting element and substantially exposing said item, said covering element having an engaging structure formed adjacent a top end thereof;

means for restricting movement of said covering element at said advanced and retracted positions;

a removable cap having an open end adapted to fit onto said covering element and removably engage said engaging structure, said cap being sized such that it fully encloses that portion of said item exposed when said covering element is in its retracted position and said cap is engaged with said engaging structure.

5. The holder according to claim 4 wherein said cap engages said engaging structure and said covering element is movably mounted to said base such that said cap may be separated from said covering element when said covering element is in its retracted position.

6. A holder for a cosmetic or hygienic item comprising:

a base having an open top end;

a cosmetic or hygienic item coupled to said base and extending through said open top end thereof;

a covering element movably mounted to said base to move longitudinally relative to said base and said item between an advanced position projecting substantially from said base and a retracted position substantially coextensive with said base, said covering element being sized such that in said projecting position thereof it substantially encloses said item and in said retracted position thereof it substantially exposes said item, said covering element having an engaging structure formed adjacent a top end thereof, wherein said covering element is mounted to move from said retracted position telescoped within said base to said advanced position substantially out of said base;

means for restricting movement of said covering element at said advanced and retracted positions;

a removable cap having an open end adapted to fit onto said covering element, and removably engage said engaging structure, said cap being sized such that it fully encloses that portion of said item exposed when said covering element is in its retracted position and said cap is engaged with said engaging structure;

said holder comprising a mounting element to which said item is mounted and means mounting said mounting element to said base, said covering element being mounted to telescope into said base enclosing a substantial portion of said mounting element in said retracted position of said covering element, wherein said means mounting said mounting element to said base comprises a plug element secured to said base, said mounting element having a receptacle and said plug element having a portion which is received and engaged in said receptacle.

* * * * *